US006843096B2

(12) United States Patent
Viegener et al.

(10) Patent No.: US 6,843,096 B2
(45) Date of Patent: Jan. 18, 2005

(54) PROCESS AND DEVICE FOR PRODUCING PRESS FITTINGS FROM STEEL, IN PARTICULAR SPECIAL STEEL

(75) Inventors: Walter Viegener, Attendorn (DE); Jürgen Nägeler, Korschenbroich (DE); Walter Bauer, Simmozheim (DE)

(73) Assignee: Witzig & Frank GmbH, Offenburg (DE)

( * ) Notice: Subject to any disclaimer, the term of this patent is extended or adjusted under 35 U.S.C. 154(b) by 10 days.

(21) Appl. No.: 10/311,810

(22) PCT Filed: May 16, 2001

(86) PCT No.: PCT/EP01/05547

§ 371 (c)(1),
(2), (4) Date: Dec. 20, 2002

(87) PCT Pub. No.: WO02/02255

PCT Pub. Date: Jan. 10, 2002

(65) Prior Publication Data

US 2004/0003645 A1 Jan. 8, 2004

(30) Foreign Application Priority Data

Jun. 30, 2000 (DE) ..... 100 31 989

(51) Int. Cl.[7] ..... B21D 41/02

(52) U.S. Cl. ..... 72/370.03; 72/370.1

(58) Field of Search ..... 72/370.03, 370.1, 72/370.13, FOR 101, 316, 318

(56) References Cited

U.S. PATENT DOCUMENTS

| | | | | | |
|---|---|---|---|---|---|
| 1,791,887 A | * | 2/1931 | Davies et al. | ..... | 72/318 |
| 3,122,830 A | * | 3/1964 | Dawson et al. | ..... | 72/364 |
| 3,230,754 A | * | 1/1966 | Arbogast | ..... | 72/316 |

FOREIGN PATENT DOCUMENTS

| | | | | |
|---|---|---|---|---|
| DE | 582 238 | | 10/1933 | |
| DE | 21 10 758 | | 9/1972 | |
| EP | 0 361 630 | | 9/1989 | |
| EP | 0 441 174 | | 8/1991 | |
| EP | 0 649 689 | | 4/1995 | |
| JP | 60-26618 | * | 6/1985 | ..... 72/FOR 101 |
| WO | WO 88 00099 | | 1/1988 | |

* cited by examiner

*Primary Examiner*—Lowell A. Larson
(74) *Attorney, Agent, or Firm*—Cohen, Pontani, Lieberman & Pavane

(57) ABSTRACT

Special steel press fittings are produced in two process steps, which can be performed simultaneously, or also one after the other. The cut to size blank is widened in a die is upset in order to form the desired pipe connection areas.

16 Claims, 6 Drawing Sheets

PROCESS AND DEVICE FOR PRODUCING PRESS FITTINGS FROM STEEL, IN PARTICULAR SPECIAL STEEL

This is a U.S. National Phase Application under 35 USC 371 of International Application PCT/EP01/05547, filed on May 16, 2001.

FIELD OF THE INVENTION

Press fittings, which are used for connecting pipe ends with each other and for making pipe junctions, have been increasingly employed for pipeline installations, for heating pipes as well as drinking water installations, or for gas pipes. For making the pipe connection, press fittings are pushed on the respective pipe ends, wherein an O-ring, which is maintained in an annular bead of the press fitting, makes a fluid-tight connection. The press fitting is plastically deformed radially inward in a press area particularly provided for this, so that it is mechanically secured on the pipe end. The connections obtained in this manner can be dependably produced and are stable over a long time.

DESCRIPTION OF THE RELATED ART

Press fittings are required to be made from the same material as the material for the pipelines. Copper press fittings are used for installation on copper pipes. EP 0 649 689 B1 addresses the manufacture. Dies placed linearly and transversely, into which an appropriately preformed blank is inserted, are used for producing these copper press fittings. In its interior shape, the die has an annular groove, which fixes the exterior shape of an annular bead to be formed on the press fitting. An upsetting device is used for forming this annular bead, which has a support mandrel which is inserted into the open pipe end of the blank lying in the die for support. To cause the wall material of the blank to flow into the annular groove, the upsetting device has a follow-up or upsetting sleeve, by means of which the pipe end in the die is axially upset. In the process, the wall material of the press fitting flows plastically into the annular groove. In order to then dependably embody the seat for the O-ring with the required precision, the support mandrel and the follow-up sleeve are removed from the die, and a roller-burnishing process is performed. A rotatably seated roller maintained on a finger is used for this, which is introduced into the pipe end and is pressed radially outward against the annular bead to be formed. The roller now performs a number of rotations, in the process of which it rolls the corresponding annular bead.

This process is designed and suitable especially for producing copper press fittings. It requires a blank, whose outer dimensions are matched to the receiving chamber of the die, so that it rests snug against the die. Therefore the blank must be given the appropriate rough shape prior to upsetting for the purpose of forming the annular bead. For this purpose it must be widened in its end areas. This step must be taken initially. Following the insertion of the pre-widened blank into the die, it is cut to size. An upsetting and rough-burnishing step is then performed in the die on the pre-widened and length-calibrated (cut to size) blank for creating the desired annular bead. Copper press fittings are obtained, which have an annular bead which is set back in respect to the pipe mouth. Pressing the press fittings is possible with appropriate pressing dies or pressing tongs, which simultaneously grasp the portions of the fitting existing on both sides of the O-ring, so that even with the use of copper as the fitting material a very good mechanical connection between the pipe end and the press fitting is obtained.

The dies for pressing the press fittings are specifically designed to the special shape of the press fittings. In case of the use of differently shaped press fittings, the respective pipe fitter must obtain new dies.

As a rule, press fittings made of special steel for the installation of special steel pipes are constructed in such a way that an O-ring seat is formed directly at their free end. A typical representative of such press fittings can be taken from EP 0 361 630 B1. This press fitting has a connection section, whose interior diameter has been widened to the exterior diameter of a pipe to be connected. At the end of the press fitting, its wall is initially bent radially outward, and is then beaded toward the inside while forming an annular bead. Such press fittings cannot be pressed with the same dies, such as are already in use in connection with copper press fittings having a pressing area on both sides of the O-ring.

The manufacture of press fittings requires machines and processes, by means of which press fittings can be dependably produced in very large quantities. For producing dependable pipe connections, it is necessary to produce the press fittings with very low tolerances. This must be possible at manufacturing costs which are as low a possible. Accordingly, the machine or device for producing the press fittings should be designed to be simple and rugged, but still be able to dependably produce press fittings of the desired quality.

SUMMARY OF THE INVENTION

Based on the foregoing, it is one object of the invention to create a device and a process for producing press fittings, in particular made of special steel, by means of which press fittings of the desired quality can be produced in a simple manner and with the required process dependability. Moreover, it is another object of the invention to produce press fittings made of special steel, which can be produced cost-effectively and can be employed in actual use.

This and other objects are attained in accordance with one aspect of the invention directed to a process for producing press fittings, in particular press fittings made of steel, particularly special steel, starting with blanks with at least one pipe end. The pipe end is received in a die and is widened with the aid of a mandrel is pushed in the axial direction into the pipe end. Then, the pipe end is axially upset in the same die in order to bend an annular area of the pipe end radially outward into an annular groove formed in the die.

Steel pipes from which sections are cut to size are the basis for producing the press fittings. The cut-off pipe sections are converted into a press fitting in an integrated step with two partial steps, wherein the two partial process steps are designed in such a way that they can be performed one after the other without an intermediate step in a single die.

For producing the press fittings, the cut to size pipe sections are widened and provided with an annular bead, which is used as an O-ring seat. Widening and beading (i.e. the formation of the bead) therefore takes place in one continuous operation, so to speak. It is not necessary to either transport the press fitting to another die, or to perform intermediate work, for example finish calibration or cutting to size, between the two partial process steps. Therefore the series of steps consists of cutting to size, widening, and application of the bead. Because of the possible combination of widening and bead application into a conversion step which can be performed in a single processing station, the processing machine can make do with a reduced number of processing stages. The combination of widening and bead application permits a quite considerable reduction of construction and structural outlay at the machine for producing press fittings which, in the end, is reflected in a considerable cost reduction of the special steel press fittings. It has been shown on the other hand that, in spite of the omission of intermediate calibration between widening and bead application, i.e. in spite of the combination of the two individual steps into an integrated process step, it is possible to produce the desired press fittings with the required dimensional accuracy and quality, so that faultless pipe connections can be produced from the mass-produced press fittings.

In the process, the diameter of the pipe end of the blank is preferably widened by more than twice the wall thickness. This creates the possibility to start out with a blank which had been cut to size from the pipe materials of the type which is to be connected by means of the press fittings in the course of the later installation. Therefore no special pipe material is required for producing the press fittings, which in turn lowers the costs and simplifies production. Moreover, widening of the pipe end has the effect that an insertion end, which limits the axial insertion depth of the pipe to be connected, is formed on the press fitting to be produced. This creates defined conditions, so that the beaded connection to be made is given the required axial tensile strength.

For executing the process, a mandrel for widening the pipe end of the blank is initially pushed axially into the latter under pressure. In the course of this, the conical front end of the mandrel widens the pipe end, which is stretched in the circumferential direction and therefore rests against the outer cylindrical surface of the mandrel with a radially inward directed force. The exterior diameter of the mandrel and the interior diameter of a corresponding section of a mold receiving the blank are matched to each other in such a way that now the wall of the widened blank rests, at least almost, against the interior wall of the mold. During the process step now following, which can chronologically overlap, i.e. start with the widening step, the pipe end is subjected to an upsetting axial force, for example by means of an annular shoulder provided in the mandrel, or by a separate pressure sleeve. This occurs surprisingly, in spite of an inward directed pretension, because of the axial upsetting force the material of the wall of the pipe end bulges outward in an annular area into an annular groove provided in the mold, wherein the special steel material is still further stretched in the circumferential direction than had occurred in the widening step. To make this possible in the represented manner, a special steel material of high tensile strength and toughness is required. The special steel material often employed in water line installations meets these requirements.

The process is suitable for producing the press fittings by starting from welded pipe material. It is possible that a surface can exist in the area of the weld seam produced in the course of a laser welding process, for example, which is not suitable for a tight seating of an O-ring. This can be the case in particular if the pipe material was welded from the outside. Relief can be provided here in that an intermediate processing, particularly of the weld seam, takes place following the upsetting step. This can take place in a rolling process, for example, in that the weld seam area in particular is rolled over several times from the inside. For example, a so-called roller-burnishing process is performed as the rolling process, wherein a roller supported on a finger and rotatably seated is introduced into the pipe end and is rolled along the formed bead on an orbital track. Preferably several thousand, preferably more than ten thousand repetitions are performed here, in which the roller is pushed radially outward. The weld seam area in particular is smoothed here. It is alternatively possible to grind the annular groove. In this connection it might possibly be sufficient to grind over only the weld seam area. While the roller-burnishing process has the advantage of closing pores and pits by pushing them closed, with the grinding process it is possible to achieve particularly short clock cycles and particularly good bead geometries.

The press fittings to be created can have one, two, three or more pipe ends—depending on their employment. The simplest employment is a straight pipe connector with two pipe ends. Cover plates only have one pipe end. Branch elements can have three or more pipe ends, wherein the blanks of such branchings are produced in a preparatory work step in such a way that appropriate straight pipe ends are provided in the desired amounts. If curved fittings are to be produced, a pipe section, which was cut to size, is initially bent in an appropriate mold, after which the above discussed process steps are performed.

The device suited for producing press fittings has a combined widening and upsetting station, part of which are at least a multi-part die, a widening mandrel and the upsetting element. The widening mandrel and the upsetting element can be combined into one element, or can be separately embodied. Both elements, the widening mandrel and the upsetting element, are employed in the same die (mold) simultaneously or one after the other. The combined widening and upsetting station therefore is a single processing station, in which widening, as well as beading, is performed without intermediate steps. Widening and beading in a single processing station allows a particularly cost-effective, but yet precise production of press fittings, i.e. the mass production of the press fittings of a quality which permits the dependable production of press connections which remain tight over a long period of time.

The die preferably has a receiving chamber with several sections, i.e. at least one first and one second section, which are of different diameters and make a transition into each other at an annular shoulder. The diameter of the first section preferably matches the exterior diameter of the not yet widened blank, while the blank in the second section should approximately correspond to the exterior diameter of the blank after the widening step. The annular shoulder formed between the first and second sections is used for defining the exterior shape of the press fitting in the transition between its not yet widened to its widened area. The annular shoulder can additionally be used as the stroke limitation for the widening mandrel, in particular if its stroke depth is not fixed by its drive mechanism.

The die can be divided parallel in relation to the longitudinal direction of the pipe end, or transversely to the latter. With parallel division, the die (the mold) is constituted by two mold halves, whose separating line lies substantially on a level with the center line of the blank. The annular groove formed in the mold halves for defining the exterior shape of the bead to be formed is provided in both mold halves and its axial extension cannot be changed. In contrast to this, the transverse division of the mold half permits the application of a separating line centrally in respect to the annular groove, so that the axial extension of the annular groove can be changed. In this case it is particularly advantageous to move the mold in the course of the widening or upsetting process in such a way that the annular groove slowly closes, i.e. its axial extension is reduced from a larger size to the desired size. By means of this it is possible to initially bulge a larger area of the pipe wall outward, because of which the bulging wall possibly molds itself better to the shape of the annular groove. However, it is essential for the annular groove to be closed before wall material has penetrated too far outward, i.e. into the gap between the mold halves.

It is possible to combine the widening mandrel and the upsetting element by forming an annular shoulder on the widening mandrel. There, the upsetting element and the widening mandrel always run synchronously in regard to each other, which results in a high degree of process dependability and a simple die. However, if required, the upsetting element can also be a separately driven pressure sleeve, which is displaceably seated on the mandrel, which is placed on the pipe end and upsets it after the pipe end has been completely widened. It is possible here to operate the pressure sleeve in a travel-controlled or force-controlled manner, for example, in order to achieve optimum production results. Anyway, the stroke of the pressure elements is dimensioned in such a way that the material of the pipe end in the area of the annular groove bulges outward, but is not pushed together into a flat disk flange. This is preferably achieved by a travel control of the pressure element. However, the widening mandrel can be connected to its drive mechanism for example by means of an interposition of a relatively strong spring, so that it runs up resiliently against the annular shoulder between the first section and the second section of the die.

The device can be additionally provided with a roller-burnishing station. The latter can be arranged in a separate processing station if a very rapid work cycle is desired. However, it is preferred to integrate the roller-burnishing station also into the widening and upsetting station. A roller, rotatably seated on a finger, as well as a drive mechanism, are part of the roller-burnishing station, by means of which the finger is inserted into the widened and beaded pipe end and is moved in a circular manner until the formed bead has the desired shape, particularly in the area of a possibly existing weld seam on the pipe wall. A grinding station can also be provided in place of the roller-burnishing station.

It is possible by means of the process and the device to produce press fittings of special steel which have a widened pipe end and an annular bead in it for receiving an O-ring as a sealing element. The special feature of these special steel press fittings resides in that pipe-shaped crimped areas of identical diameter and approximately the same axial length are provided on both sides of the O-ring, i.e. the annular bead, which can be used as crimping area. With these, the special steel press fitting is pressed on both sides of the O-ring together with a pipe end, which is to be connected. This not only actually increases the assembly dependability and the solidity of the connection, but also the acceptance in the market place, and moreover permits the employment of crimping tools such as have so far been used for copper press fittings.

DETAILED DESCRIPTION OF THE DRAWINGS

Figure 1:
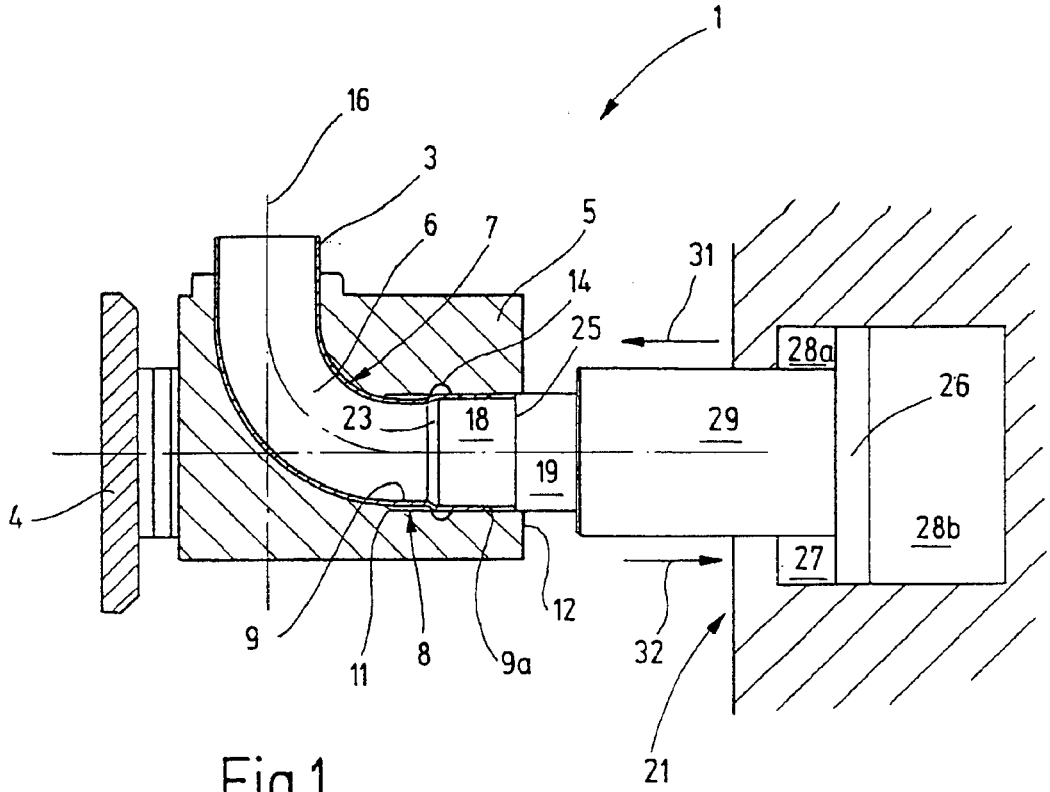
FIG. 1, a schematic sectional view of a device for producing press fittings, having a die, a mandrel and an upsetting element, during the widening step and prior to upsetting, FIG. 2, a schematic sectional view of the die in FIG. 1 at the end of the widening step and the upsetting step, FIG. 3, the die in FIG. 1 during the roller-burnishing process, FIG. 4, a schematic sectional view of a modified embodiment of a device for producing press fittings in the course of the widening step, FIG. 5, a simplified and schematic sectional view of the device in FIG. 4 at the end of the widening and upsetting step, FIG. 6, a schematic sectional view of a further embodiment of a device for producing press fittings in the course of the widening step, FIG. 7, a schematic sectional view of the device in FIG. 6 after widening and upsetting, FIG. 8, a schematic sectional view of a further embodiment of the device of the invention, having a movable die, during the upsetting process, FIG. 9, a schematic sectional view of the device in FIG. 8 at the end of the two processing steps (widening and upsetting), and FIG. 10, a schematic sectional view of a finished special steel press fitting for connecting two special steel pipes.
Figure 10:
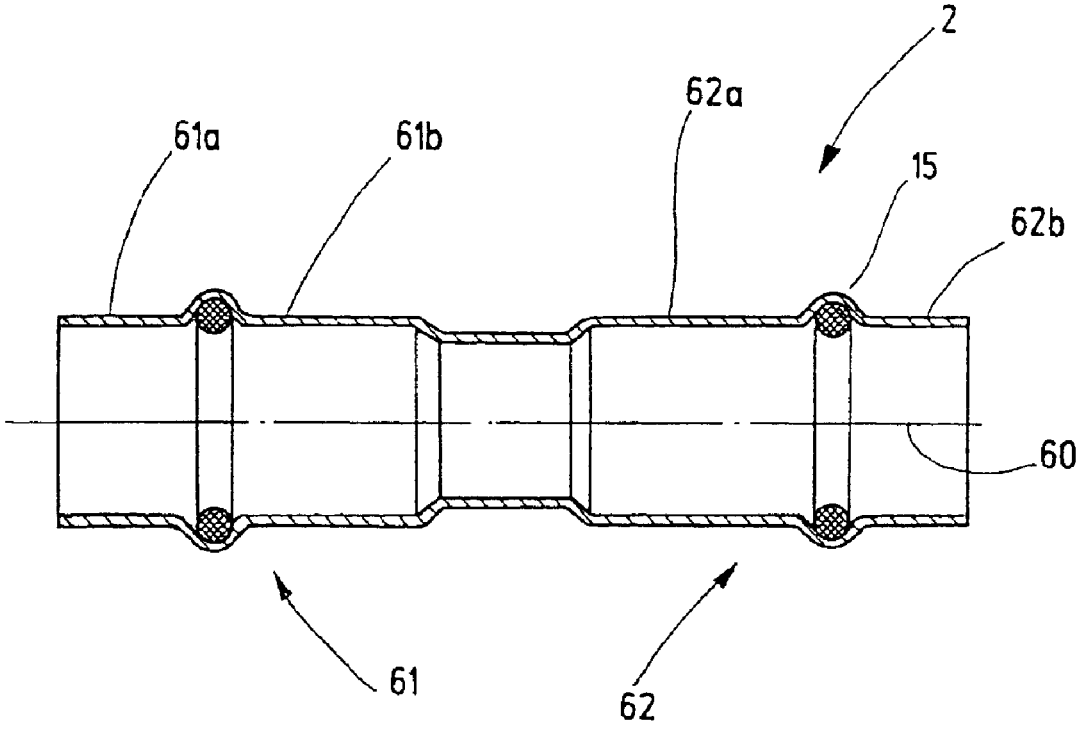

A device 1 is illustrated in FIG. 1 for producing press fittings, such as can be seen in FIG. 10 in the form of a straight press fitting 2, for example. The device 1 in FIG. 1 is used for producing curved press fittings, which are based on pre-bent, cut to size and pipe-shaped blanks 3 of constant interior and exterior diameters.

The device 1 has a mold or die 5, which is held on a base 4 and can be divided and encloses a receiving chamber 6 with a first section 7 and a second section 8. The first section 7 of the receiving chamber 6 has an interior diameter which matches the exterior diameter of the blank 3. The second section 8 is used for receiving a pipe end 9 of the blank 3, which will constitute the later crimping area of the press fitting to be formed. The interior diameter of the substantially cylindrical second section 8 of the receiving chamber 6 is greater than the exterior diameter of the non-deformed pipe end 9. The interior diameter of the second section 8 is preferably greater by twice the wall thickness of the pipe end 9 than the exterior diameter of the non-deformed pipe end 9. A conical annular shoulder 11 connects the two sections 7, 8 of the interior chamber 6. An annular groove 14, which fixes the exterior contour of an annular bead 15 to be formed on the press fitting 2 is formed at some distance from the annular shoulder 11 and preferably at an even greater distance from the open end 12 of the receiving chamber 6. The annular groove 14 forms a closed ring of a constant, approximately semicircular cross section.

The die 5 illustrated in FIG. 1 is divided parallel in respect to a longitudinal direction 16 of the receiving chamber 6. The longitudinal direction 16 matches the two axial directions of the open pipe ends of the blank 3.

A widening mandrel 18, an upsetting element 19 and a drive mechanism 21 belong to the die 5. The widening mandrel 18, the upsetting element 19, the drive mechanism 21 and the die 5 constitute a combined widening and upsetting station of the device 1.

The widening mandrel 18 is a cylindrical element provided with a bezel 23 on its front face, whose exterior diameter is slightly larger than the exterior diameter of the not yet widened pipe end 9. The bezel 23 defines a conical annular face, whose diameter directly adjoining the front face of the widening mandrel 18 is less than the interior diameter of the not yet widened pipe end 9. The bezel 23 includes an acute angle of taper of such a size, that the widening mandrel 18 can be inserted into the pipe end 9 while widening it, and without compressing the pipe end 9 in front of it. The length of the widening mandrel 18 is greater than the distance between the annular shoulder 11 and the annular groove 14.

The widening mandrel 18 is connected rigidly and, if desired, as one piece with the upsetting element 19 which, in the embodiment in FIG. 1, is constituted by a cylinder body, which makes a transition via a step- or annular shoulder-like transition 25 into the cylindrical widening mandrel 18. The cylinder body has an exterior diameter which exceeds the interior diameter of the widened pipe end 9. The exterior diameter of the cylinder body is preferably less than the interior diameter of the second section 8 of the interior chamber 6, so that the mandrel, or the body constituted by the widening mandrel 18 and the cylinder body, can enter into the second section 8 of the receiving chamber 6.

The drive mechanism 21 which, in the present exemplary embodiment is constituted by an hydraulic drive mechanism, is used for actuating and moving this combined widening and upsetting mandrel. Part of this is a piston 26, which divides a cylinder chamber 27 into a work chamber 28*a* and a further work chamber 28*b*. The piston 26 is connected with the widening mandrel 18 and the upsetting element 19, for example via a piston rod 29. Fluid channels, not represented in detail, are used for the selective charging of the work chambers 28*a*, 28*b* with hydraulic fluid under pressure. By means of this the piston rod 29 can be specifically moved in both axial directions respectively in the direction of the arrows 31, 32.

Figure 2:
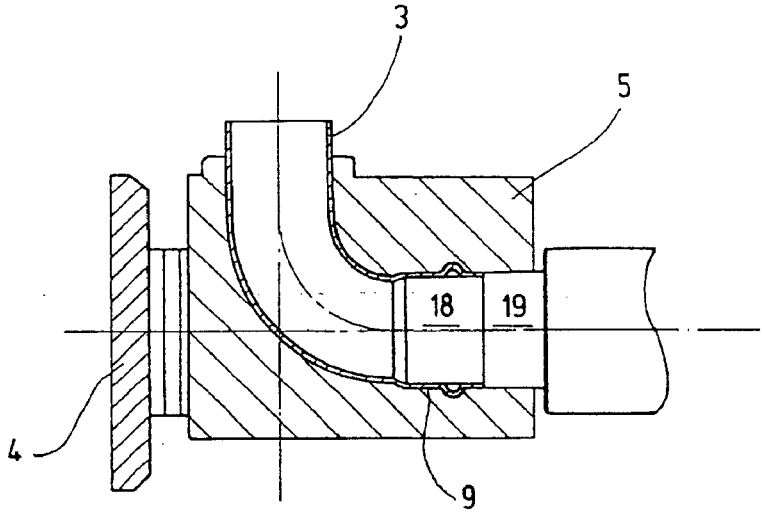

The device 1 described so far operates as follows:

Cut to size and pre-bent pipe-shaped blanks 3 of constant diameter are the basis. These are placed into the die 5, after which the die is closed. The blank 3 extends with its pipe end 9 into the section 8 of the receiving chamber 6, but does not rest against the die 5. The blank 3 is axially fixed in the die 5 by means of its curvature. The mandrel 18 is in its farthest possible right position in FIG. 1 and is not yet in contact with the pipe end 9. Now the work chamber 28*b* is charged with fluid, so that the piston 26, and with it the piston rod 29, the upsetting element 19 and the widening mandrel 18 are moved toward the die 5, as indicated by the direction of the arrow 31. In the course of this, the widening mandrel 18 is placed with its bezel 23 on the front face of the pipe end 9, which has been preferably deburred and, if required, provided with a slight inner and outer bezel. Because of the continued axial movement of the widening mandrel 18, it penetrates the pipe end 9 and widens it in the process, but does not substantially compress it. A certain shortening of the pipe end 9 can occur because of the now appearing stretching of the wall of the pipe end 9 in the circumferential direction. The widened pipe end 9 rests under tension against the surface of the widening mandrel 18. The latter continues to slide further into the interior chamber of the pipe end and widens longer and longer sections of the pipe end. Before the bezel 23 reaches the annular shoulder 11, the upsetting element 19, i.e. the appropriate step 25 (annular shoulder) is placed on the front face 9*a* of the pipe end 9. In the course of the further movement of the piston 26, the pipe end 9 is now upset, because of which the wall of the pipe end 9 spontaneously bulges outward in the area of the annular groove 14 against its own, radially inward directed pretension. This takes place over the entire circumference. The length of the upsetting stroke is dimensioned in such a way that the upsetting process is terminated once the wall of the pipe end 9 completely rests in the annular grove 14. This is illustrated in FIG. 2. The upsetting stroke is approximately as long as the difference between the wall length of the annular bead and the axial length thereof.

The length of the stroke can be dimensioned by an appropriate design of the drive mechanism 21, for example in that the piston stroke is correspondingly limited. When the work stroke is terminated, i.e. the pipe end 9 is widened and upset, as illustrated in FIG. 2, the pressure in the work chamber 28*b* is relieved and the work chamber 28*a* is charged with pressure, so that the piston 26, and with it the upsetting element 19 and the widening mandrel 18 are moved out of the die 5 in the direction of the arrow 32 and release the now produced press fitting. The latter can now be removed from the mold 5 in that the latter is opened and a fresh blank 3 is inserted, after which the above explained work process is repeated. Therefore only a single piston stroke of the piston 26 is required for producing the press fitting. Production is effective and precise.

Figure 3:
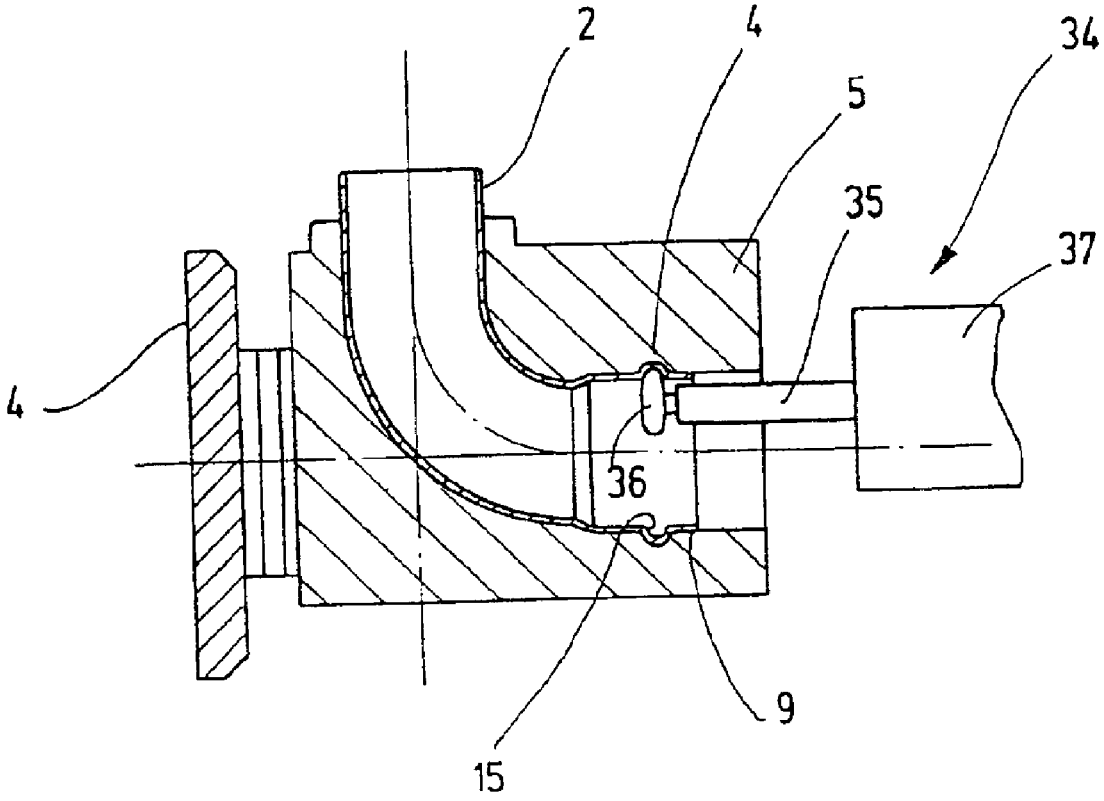

For the case wherein the blank 3 was cut to size from a welded pipe in particular, it is recommended to add a further work step, which can be performed in the same die 5, or in a separate die. In the example illustrated in FIG. 3, the first mentioned option is exercised. The upsetting of the blank 3 has already been finished and it still remains in the mold 5 for the roller-burnishing step. A roller-burnishing device 34 is used for performing the roller-burnishing step. Part of the latter are a finger-like support 35, on whose free end a roller 36 is rotatably seated, whose diameter is clearly less than the interior diameter of the widened pipe end 9. The support 35 is connected with a drive and positioning device 37 which is arranged for placing the roller 36 against the wall. Then the support is moved so that the roller 36 is run into the interior of the pipe end 9 and is then moved in the radial direction in such a way that the roller 36 performs a circumferential movement in the annular bead 15 which had been formed. For example, the roller-burnishing process is performed for a length of 2 to 4 seconds at a number of revolutions of more than 5000 rpm. In this way more than 100 rotations result, which cause the sufficient smoothing of the inside of the annular bead, in particular in the area of a possible weld seam. It is alternatively possible to provide a driven grinding disk in place of the roller 36, which grinds over the entire annular bead 15, or only the area of the weld seam.

Figure 4:
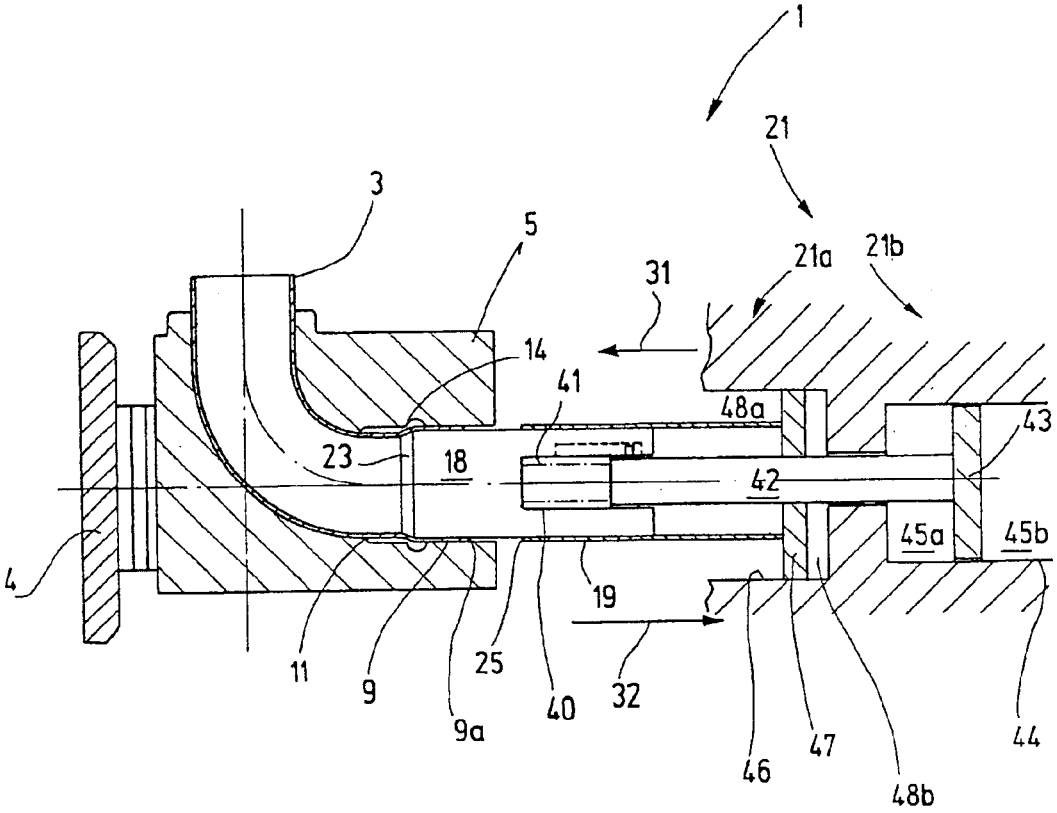

A modified embodiment of the device 1 is illustrated in FIG. 4. To the extent that the device 1 agrees with the device in FIG. 1, the same reference numerals are employed and reference is made to the description above.

In contrast to the previously described device 1, the device 1 in FIG. 4 has a drive device 21 with separate drive mechanisms 21*a*, 21*b* for the widening mandrel 18 and the upsetting element 19. On its side remote from the bezel 23, the widening mandrel 18 is provided with a blind bore 40, which houses a compression spring 41. The latter is supported on the bottom of the blind bore 40. A piston rod 42 of a hydraulic piston 43 dips into the blind bore 40. The piston is arranged in a hydraulic cylinder 44 and there separates two work chambers 45*a*, 45*b*. By means of a specific charging of the work chambers 45*a*, 45*b* with pressure, the widening mandrel 18 can be moved in both directions 31, 32. In this case the stroke of the piston 43 is so great that the widening mandrel 18 can run up against the annular shoulder 11. The latter is used as a stroke limitation for the piston 18. The spring 41 is so stiff that in the course of the widening mandrel 18 entering the pipe end 9 the spring is not at all, or only slightly, compressed. This causes a precise formation of the diameter transition of the blank 3 from the widened pipe connector area 9 to the not widened area. Moreover, the device 1 becomes insensitive to positioning tolerances between the die 5 and the drive device 21.

A further special feature of the embodiment of the device 1 illustrated in FIG. 4 resides in the upsetting element 19. The latter is embodied as a sleeve, which is displaceably seated on the widening mandrel 18. The sleeve is provided with its own drive mechanism 21*a*, part of which is a piston 47 seated in a cylinder 46. The latter separates two work chambers 48*a*, 48*b*, which can be selectively and specifically charged with hydraulic fluid. In this way the sleeve can be specifically moved in the direction of the arrows 31, 32 in order to contact the front face 9*a* of the pipe end 9 with its own front face and to upset the pipe end 9. The two drive mechanisms 21*a*, 21*b* can be controlled independently from each other, by means of which the widening and upsetting of the pipe end 9 can be optimized. This embodiment has particular importance where the dies 5 must often be changed in a machine in order to be able to produce different press fittings.

Figure 5:
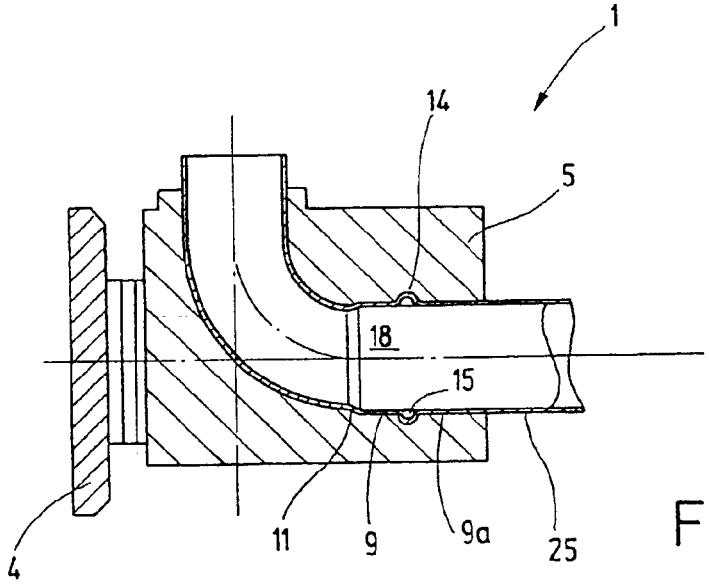

While FIG. 4 illustrates the widening of the pipe end 9, FIG. 5 represents the status of the device 1 at the termination of the upsetting step. The widening mandrel 18 has pressed the pipe wall firmly against the inner shoulder 11. The pipe end 9 is completely widened and the sleeve has dipped into the die 5 and has upset the pipe end 9 to such an extent that the pipe wall just fills the annular groove 14, and therefore the desired bead 15 has been formed.

Figure 6:
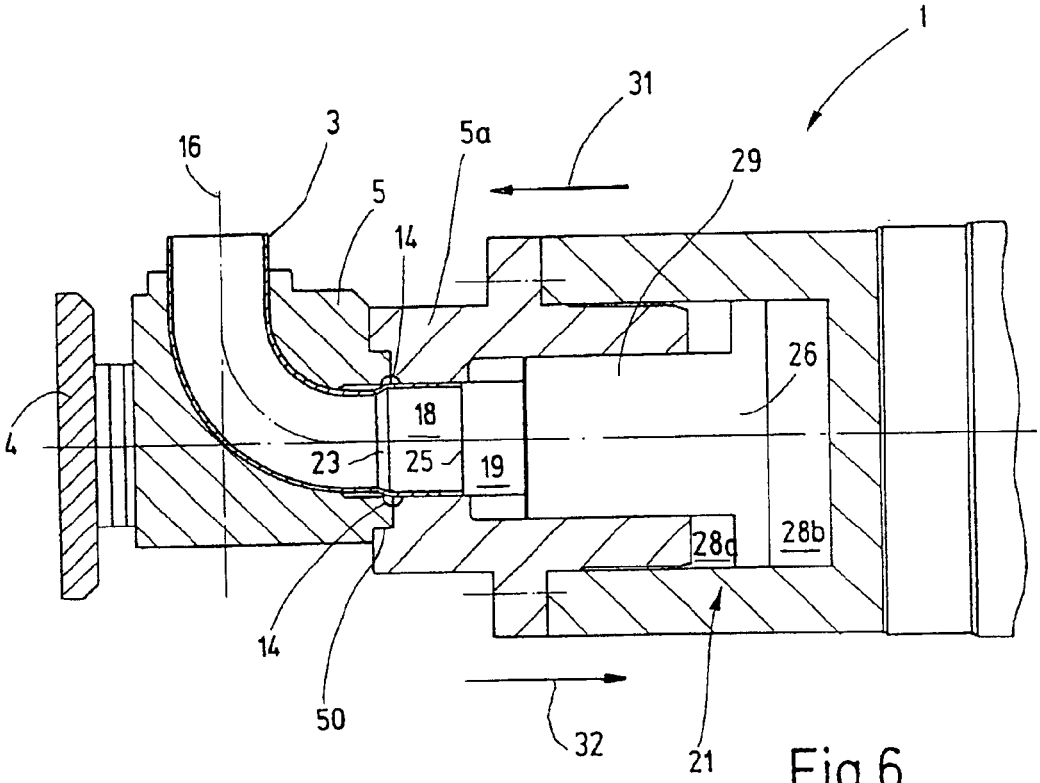

A further embodiment of the device 1 is illustrated in FIG. 6. To the extent that there is agreement with the previous embodiments, reference is made, based on the same reference numerals, to the above description.

In contrast to the above described embodiments, the die 5 of the device 1 is not only divided into two, but into three. In addition to a division parallel with the longitudinal center axis 16, it is divided in a plane located in the annular groove 14. Thus, a die element 5*a* exists, which can be placed against the remaining die 5 prior to, during or after upsetting. An appropriate cylindrical seat 50 is used for centering. The die element 5*a* is preferably attached to the seat 50 of the die 5 prior to the commencement of the upsetting step. For this purpose, the die element 5*a* is moved toward the die 5 in the direction of the arrow 31 by means of an appropriate positioning device. The positioning device furthermore supports the drive device 21 for actuating the widening mandrel 18 and the upsetting element 19. Once both process steps, i.e. widening and upsetting, have been performed, the device 1 is in the status illustrated in FIG. 7. Now the piston 26 is retracted out of the pipe end 9 by charging the work chamber 28*a* with pressure. Thereafter the die element 5*a* is moved away from the die 5 in the direction of the arrow 32. By means of this the pipe end 9 is partially freed. After opening the remaining die 5, the press fitting 3 can now be removed. The advantage of this embodiment rests in that the die element 5*a* maintains the two other elements of the die 5 together at the seat 50, and that in this case a precisely operating die can be constructed in a simple way, in particular in the area of the annular groove 14.

Figure 7:
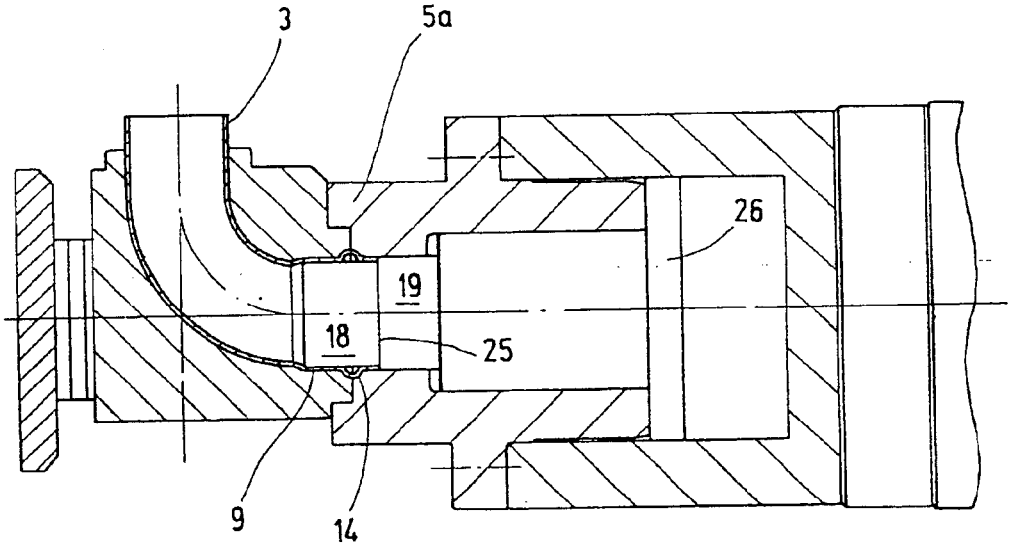
Figure 8:
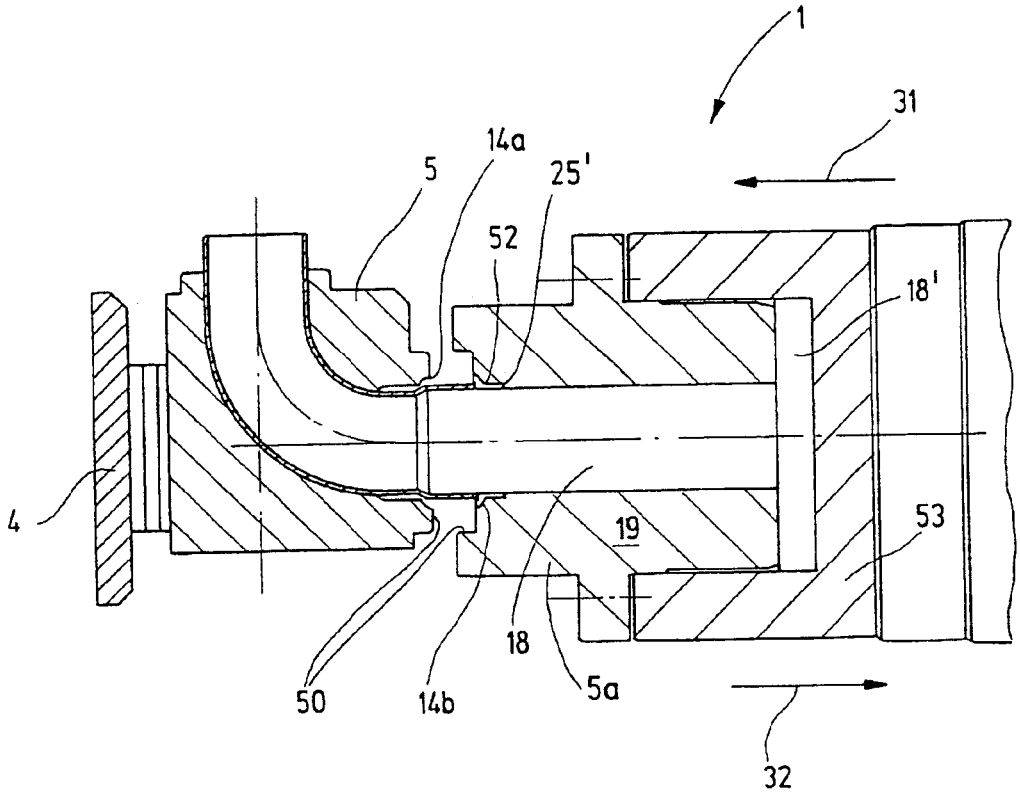
Figure 9:
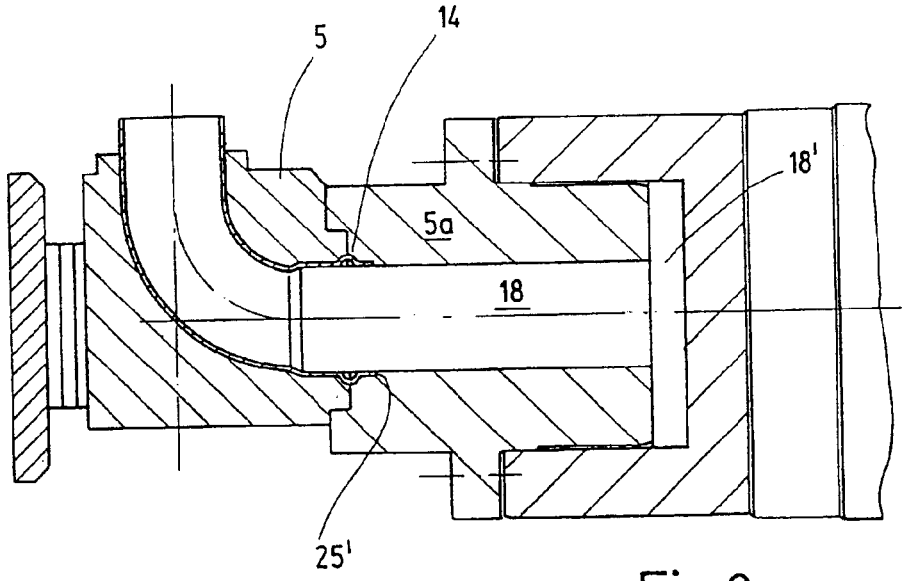

A modified embodiment of the device 1 illustrated in FIGS. 6 and 7 is represented in FIGS. 8 and 9. While in the previously described embodiment (FIGS. 6 and 7) the widening mandrel 18 and the upsetting element 19 were movably guided and driven in relation to the die element 5, the widening mandrel 18 in the embodiment of the device 1 in FIGS. 8 and 9 is rigidly maintained on the die element 5*a*, and the upsetting element 19 is embodied as an annular pressure face 25' on the die element 5*a*. The latter as a whole is connected with a drive device, not further represented, and is specifically movable in the direction of the arrows 31, 32.

Adjacent its half 14*b* of the annular groove 14, whose other half 14*a* is housed in the remaining die 5, the die element 5*a* has a bore 52 which, at a defined distance from the annular groove half 14*b*, is reduced to the diameter of the widening mandrel 18. The latter penetrates the rest of the bore 52. On its end it is provided with an end plate 18', which is braced by the die element 5*a* against an abutment 53. The unit of the abutment 53, the die element 5*a* and the widening mandrel 18 formed in this way can be moved as a whole toward the die 5 and away from it by means of the drive device. The distance between the annular face 25' and the annular groove 14 is again of such a size that, when the mold 5, 5*a* is closed, the widened pipe end 9 is upset to such an extent that the bulging pipe wall just fills the closing annular groove 14. This is illustrated in FIG. 9. Here, the work is performed by means of a mold with a total of three elements and a single drive device for the widening mandrel 18, as well as for the upsetting element 25'.

It is possible to produce press fittings 2, such as illustrated by way of example in FIG. 10, by means of the above described devices and the corresponding process. Such a special steel press fitting is produced from a welded piece of pipe, whose weld seam 60 is schematically illustrated in FIG. 10. It has one, two or more pipe connecting areas 61, 62, all of which are embodied to be hollow-cylindrical. Each pipe connecting area 61, 62 has two hollow-cylindrical sections 61*a*, 61*b*, 62*a*, 62*b*, between each of which the annular bead 15 is arranged. The two cylindrical sections 61*a*, 61*b*, 62*a*, 62*b* have the same interior diameter. They constitute crimping areas for the connection of pipes. The pipes to be connected are then mechanically connected to both sides of the respective O-ring 63 with the press fitting 2.

The disclosed process permits the production of special steel press fittings practically in a single work step, which comprises two process steps, which can be performed simultaneously, or also one after the other. The cut to size blank is widened in a die and is upset in order to form the desired pipe connection areas 61, 62. The process has been shown to be dependable for special steel press fittings. Other pressure-resistant and tough metals can also be employed. The process is particularly suitable in connection with a following roller-burnishing step or grinding step for producing press fittings from welded special steel pipes.

What is claimed is:

1. A process for producing a press fitting, starting with a blank having a pipe end, comprising a first process step which includes receiving the pipe end in a die and widening the pipe end with the aid of a mandrel, having an exterior diameter that exceeds the interior diameter of the pipe end, by pushing the mandrel in the axial direction into the pipe end, and comprising a second process step which includes axially upsetting the pipe end in the same die as a separate consecutive step immediately following the first process step in order to bend an annular area of the pipe end radially outward into an annular groove formed in the die.

2. A process for producing press fittings in accordance with claim 1, characterized in that in the first process step the diameter of the pipe end is widened by more than twice the wall thickness of the pipe end.

3. A process for producing press fittings in accordance with claim 1, characterized in that the mandrel, which had been moved into the pipe end in the first step remains in the pipe end during the execution of the second process step.

4. A process for producing press fittings in accordance with claim 1, characterized in that the blank is produced from a welded special steel pipe.

5. A process for producing press fittings in accordance with claim 1, characterized in that a cut to size piece from a welded pipe is used as the blank.

6. A device (1) for producing a press fitting, starting with a blank having (3) a pipe end (9), said device comprising a combined widening and upsetting station (22), which includes at least the following elements:

a multi-part die (5) having a receiving chamber (6) for the blank (3), wherein the receiving chamber (6) for the blank (3) has at least one section (7) of the same diameter as the blank (3), and a second section (8) of an interior diameter which is greater than the exterior diameter of the pipe end (9), wherein the second section (8) has an annular groove (14) on its interior face in order to fix the exterior shape of an annular bead to be formed on the pipe end (9), a widening mandrel (18), which is guided to move axially into the second section (8) of the receiving chamber (6) and out of it, is connected with a drive device (21), and having an exterior diameter that exceeeds the interior diameter of the pipe end (9), but is less than the interior diameter of the section (8) into which the widening mandrel (18) is to be moved, so that an annular space is defined between the widening mandrel (18) and the interior face of the second section (8), having a radial thickness that approximately corresponds to the wall thickness of the press fitting (3), and an upsetting element (19), which is guided so that it moves axially toward the annular groove (14) of the die (5) and away from it and is connected with the drive device (21) and has an annular pressure face (25) which is designed to be brought into contact with the pipe end (9) and to upset the pipe end (9), the upsetting element (19) being operatively arranged and dimensioned so that the annular pressure face (25) upsets the pipe end to form the annular bead as a separate consecutive step after the pipe end is widened in the second section by the widening mandrel.

7. The device in accordance with claim 6, characterized in that the interior chamber (6) of the die (5) has an annular shoulder (11) between the first section (7) and the second section (8).

8. The device in accordance with claim 6, characterized in that the die (5) is embodied in two parts and is divided along a face which is arranged parallel to the longitudinal pipe direction (16) of the press fitting (2).

9. The device in accordance with claim 6, characterized in that the die (5) is divided transversely in respect to the longitudinal pipe direction (16) of the blank (3).

10. The device in accordance with claim 9, characterized in that a portion **(5*a*) of the die (5) is rigidly connected with the widening mandrel (18), as well as with the upsetting element (19)**.

11. The device in accordance with claim 6, characterized in that the widening mandrel (18) is connected with a drive mechanism **(21*b*) by a spring (41)**.

12. The device in accordance with claim 6, characterized in that the widening mandrel (18) is rigidly connected with its drive device (21).

13. The device in accordance with claim 6, characterized in that the widening mandrel (18) is rigidly connected with the upsetting element (19), and the drive device (21) for the widening mandrel (18) simultaneously constitutes the drive device (21) for the upsetting element (19).

14. The device in accordance with claim 6, characterized in that the upsetting element (19) and the widening mandrel (18) have drive mechanisms **(21*a*, 21*b*)**, which are independent of each other.

15. The device in accordance with claim 6, characterized in that the device additionally has a roller-burnishing device (34).

16. The device in accordance with claim 6, characterized in that the device additionally has a grinding station with a grinding disk, which can be moved into the pipe end (9) and can be placed in a radial movement into the annular bead (15) in order to perform a grinding operation in the latter.

* * * * *